US005682150A

United States Patent [19]

Votava

[11] Patent Number: 5,682,150

[45] Date of Patent: Oct. 28, 1997

[54] REMOTE CONTROL TRAIN WARNING APPARATUS

[76] Inventor: Robert Bob Votava, 481 Post Rd., Wakefield, R.I. 02879

[21] Appl. No.: 725,629

[22] Filed: Oct. 3, 1996

[51] Int. Cl.[6] ..... G08G 1/095

[52] U.S. Cl. ..... 340/908; 340/473; 340/825.69; 340/825.72; 340/901; 340/908.1; 246/125

[58] Field of Search ..... 246/125, 126, 246/127, 292, 167 A; 340/473, 901–904, 908, 908.1, 825.69, 825.72

[56] References Cited

U.S. PATENT DOCUMENTS

| | | | |
|---|---|---|---|
| 1,832,812 | 11/1931 | Keenan | 246/127 |
| 2,829,362 | 4/1958 | Terril | 340/22 |
| 3,060,406 | 10/1962 | Luright | 340/31 |
| 3,867,718 | 2/1975 | Moe | 340/31 |
| 3,886,519 | 5/1975 | Hovland | 340/135 |
| 4,713,910 | 12/1987 | Quante | 49/49 |
| 4,879,554 | 11/1989 | Diaz-Silveira | 340/932 |
| 4,901,071 | 2/1990 | Fletcher | 340/932 |
| 4,941,284 | 7/1990 | Stoller | 49/49 |
| 5,118,056 | 6/1992 | Jeanise | 246/127 |
| 5,422,638 | 6/1995 | Singer et al. | 340/908.1 |

FOREIGN PATENT DOCUMENTS

| | | |
|---|---|---|
| 286627 | 3/1988 | European Pat. Off. . |
| 2425642 | 12/1975 | Germany . |
| 9204699 | 3/1992 | WIPO . |

*Primary Examiner*—Jeffery Hofsass
*Assistant Examiner*—Timothy Edwards, Jr.
*Attorney, Agent, or Firm*—Robert W. J. Usher

[57] ABSTRACT

A train warning device has a ladder frame with barrier sign hingedly mounted for movement by an electric motor between positions folded against the frame between the tracks and upstanding transversely from the tracks. Releasable clamping arms are mounted at the top and bottom of ladder uprights for securement thereof to track ties and enabling passage of a train thereover when folded. A signal receiver/micro computer mounted on the ladder frame controls the motor operation in response to a signal received from a hand held remote controller. A battery mounted on the ladder frame supplies power to the electric motor, signal receiver and other devices such as lamps to ensure independent operation. The barrier sign is profiled as a flagman with a sprung warning arm carrying a stroboscopic lamp. The ladder frame can be used to access the track from an elevated platform.

11 Claims, 4 Drawing Sheets

REMOTE CONTROL TRAIN WARNING APPARATUS

FIELD OF THE INVENTION

The invention relates to a portable, remote-control warning apparatus for rail transit systems.

BACKGROUND OF THE INVENTION

Traditionally, when a track/infrastructure repair crew is working, a person (flagman) is stationed several hundred feet in front of the crew to alert an oncoming transit car that work is underway and that the vehicle must stop until the warning flag or other device is removed and replaced by the appropriate proceed signal.

It is an object of the invention to obviate the need for a flagman by providing provide a robot device to replace the flagman thereby obtaining a substantial decrease in applied costs.

According to one aspect of the invention there is provided a portable, remote-control warning apparatus for rail transit systems comprising a remote-controlled, train warning device and a hand held remote controller therefor. The train warning device comprises an elongate ladder frame and a warning barrier sign is hingedly mounted on the ladder frame for movement between a retracted position, folded adjacent and, preferably, along the ladder frame and an extended position, upstanding transversely from the ladder frame, respectively. Releasable clamping means are mounted on the ladder frame for securement thereof to rail ties to lie between a pair of tracks so that a train on the tracks can pass over the warning device with the warning barrier sign in retracted position.

An electric motor mounted on the ladder frame is connected to the warning barrier sign for effecting said movement and a signal receiver/motor controller on the ladder frame is connected to the electric motor for actuation thereof in response to a signal received from the hand held remote controller. A battery is mounted on the ladder frame to supply power to the electric motor and the signal receiver, ensuring independent operation.

A designated crew member operates the hand held remote controller to transmit a signal to the signal receiver to actuate the electric motor to move the warning barrier into said extended, position upstanding from the tracks in the path of a train when the crew is working, and into said retracted position lying substantially horizontally between the tracks when the crew is clear of the tracks, to stop and release a train, respectively.

Preferably, the height of the warning device, when folded is less than the height of the rails between which it is clamped ensuring clearance for all trains to pass thereover.

A particular advantage accruing from the ladder frame is that it can be turned over and used as a ladder affording the crew ease of access to the track from an elevated platform.

The warning barrier sign is desirably a flat panel so that it can be folded against the steps confined between the ladder frame uprights and within the profile thereof both to avoid risk of damage when used as a ladder and for compactness and ease of carrying.

As the sign extends along the track when folded, the length is not limited by the track width so that it can be as much as six feet in height so that it can easily be seen and simulate the dimensional profile of a flagman.

A safety switch can be provided on the warning device to sound an alarm if a train collides therewith.

The reflective panel has an arm carrying a strobe light at a free end thereof and is hingedly connected at a root end thereof to a body portion and spring biased for movement from a concealed position, folded between the panel and the ladder frame, to an open position in which it extends outward away from the body in a plane of the panel when the warning barrier sign moves from the retracted to the extended position. This maximizes the height of light display while maintaining compactness and protection of the arm for ease and safety of portability when folded.

The robot device is called "TRACY" which is an acronym for "TRANSIT ROBOT ALERT COMMUNICATING TO YIELD"

BRIEF DESCRIPTION OF THE DRAWINGS

Specific embodiments of the of the invention will now be described by way of example only with reference to the accompanying drawings in which.

DESCRIPTION OF PARTICULAR EMBODIMENTS

Figure 1:
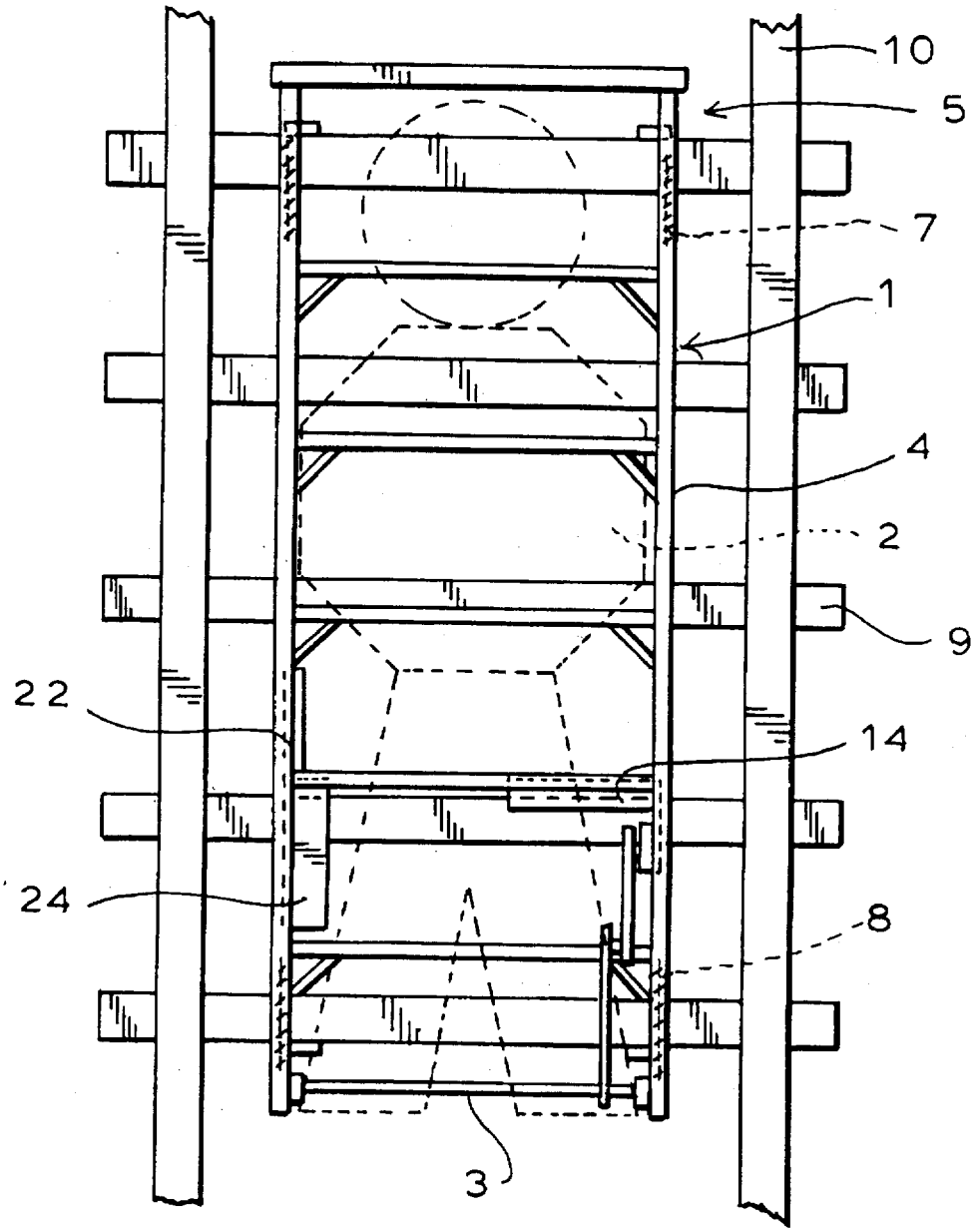
FIG. 1 is a plan view of a ladder frame of the first embodiment installed on a railway track with the warning sign shown in broken lines in retracted or closed position.
Figure 2:
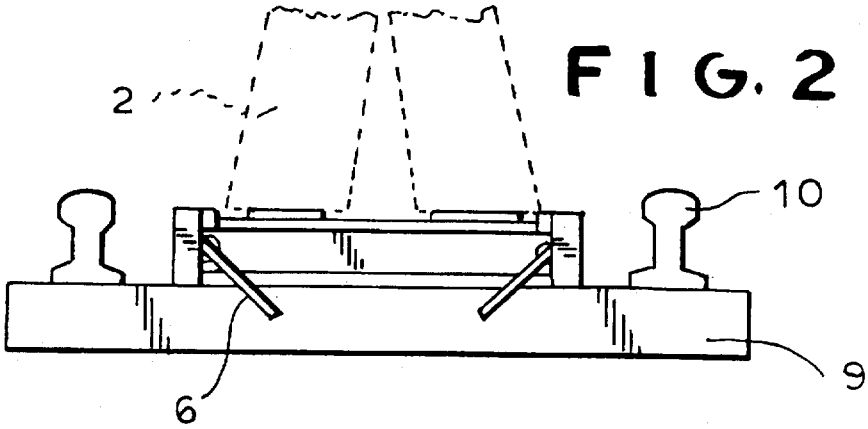
FIG. 2 is an end elevation of the first embodiment.
Figure 3:
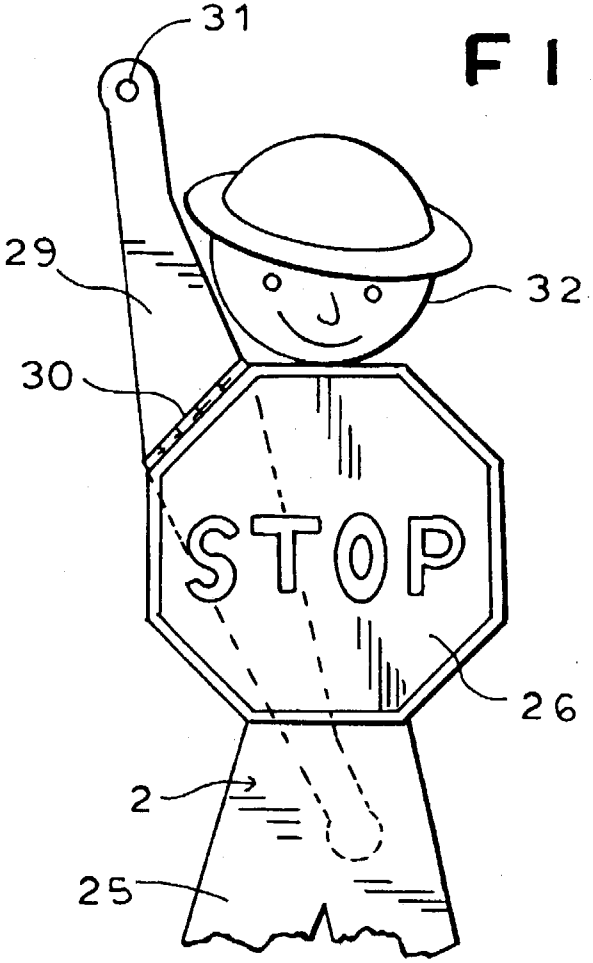
FIG. 3 is a fragmentary view of the warning sign.

As shown in FIGS. 1–5, the train warning device includes a ladder frame 1 of approximately 6 feet in length to which a panel form, warning barrier sign 2 is hingedly mounted by fixture of the bottom thereof to a rotating shaft 3 mounted between the ladder frame uprights 4 for movement between a retracted position, folded adjacent and, along the ladder frame and an extended position, upstanding transversely from the ladder frame, respectively, as indicated in FIGS. 1 and FIGS. 2–3, respectively. Releasable clamping means comprising clamping arms 5 and 6, with respective biasing springs 7 and 8, are mounted on the uprights 4 adjacent the top and bottom for securement thereof to ties 9 between a pair of tracks 10. The overall height of the device when folded flat is less than that of the rails so that a train on the tracks can pass over the warning device with the warning barrier sign in retracted position.

Figure 5:
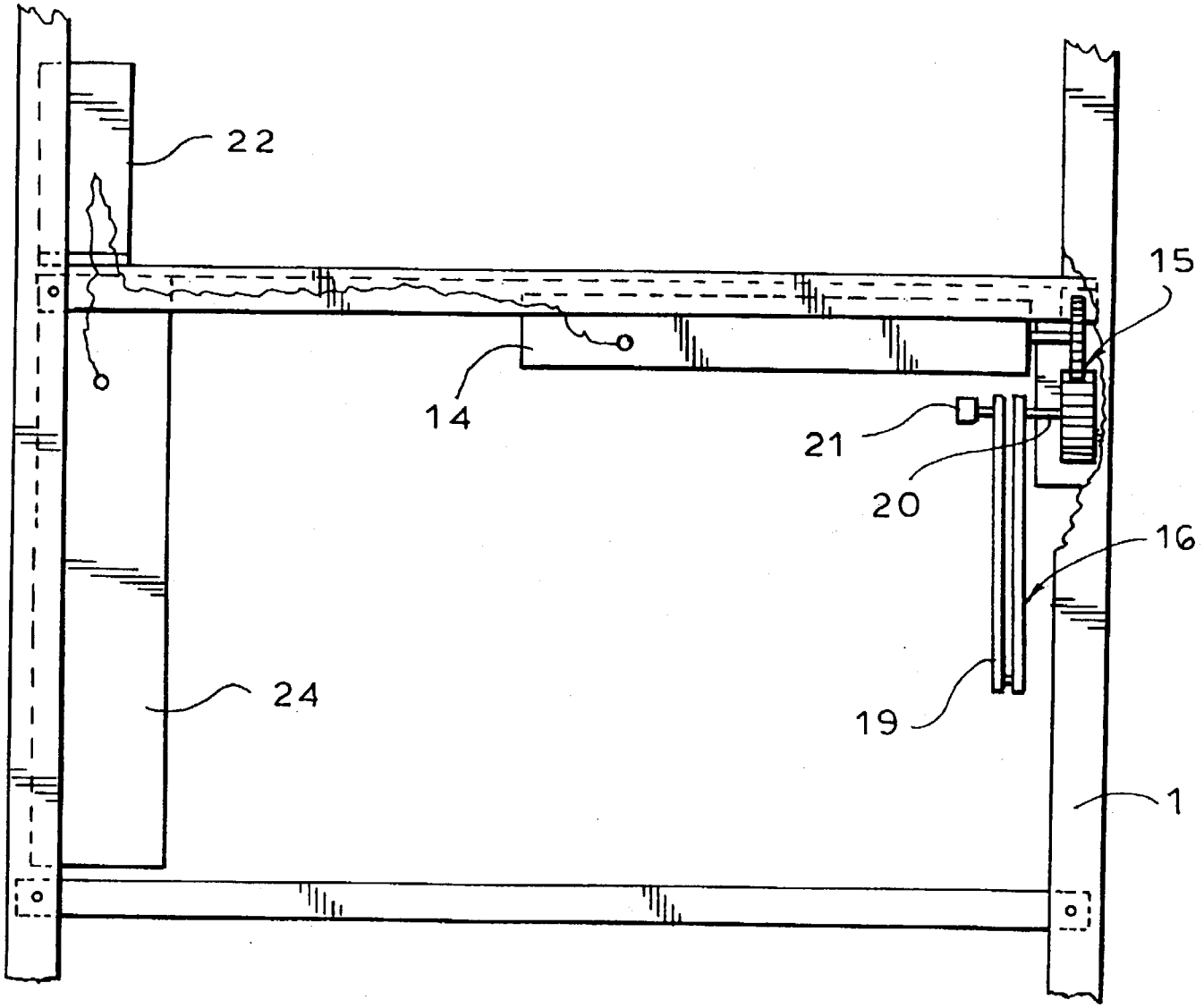
FIG. 5 is a schematic fragmentary view of a portion of the ladder frame showing the operating mechanisms in greater detail.

An electric reversing motor 14 (12 volt) mounted on the ladder frame is connected to the warning barrier sign through gear train 15 and scissor linkage 16 which, as shown in FIG. 5, comprises first and second arms 17 and 18 having one of the ends pivotally connected together at 19 and respective opposite ends, rigidly connected to the gear output shaft 20 and pivotally connected to the panel of the warning barrier sign at 21, respectively. Rotation of the motor in opposite directions brings the arms 17 and 18 into and out from adjacent parallel relation thereby to lower and to raise the warning barrier sign, respectively.

Figure 8:
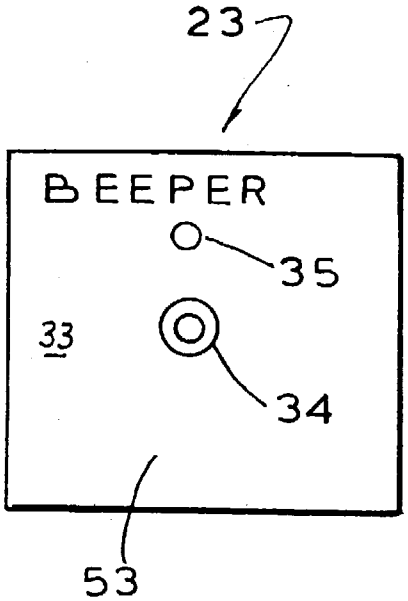
FIG. 8 is a schematic pan view of the remote controller or beeper.

A signal receiver/micro computer 22 for controlling the operation is mounted on the ladder frame and connected to the electric motor for actuation thereof in response to a signal received from the hand held remote controller 23, shown in FIG. 8. A battery storage case 24 is mounted on the ladder frame to accommodate a 12 volt battery to supply power to the electric motor, signal receiver and other devices such as lamps to ensure independent operation.

As shown particularly in FIG. 3, the panel form warning sign 2 has the general profile of a human flagman with a reflective surface which is fluorescent yellow in a leg area 25 which is surmounted by a 24 inch, red and white, body forming, octagonal stop sign 26 to a shoulder of which an arm 29 is attached by a spring hinge 30, biasing the arm in an open or raised position. A free end of the arm 29 carries a stroboscopic lamp 31. A circular head area 32 is surmounted by a "hard hat" profile carrying the transit company's logo and colors. In the retracted position, the arm is folded between the body panel and the steps of the ladder for protection, compactness and portability and springs up when the warning barrier sign is raised by the electric motor.

The ladder frame is made from fiberglass where the rails are electric for safety reasons and otherwise of aluminum.

As shown in FIG. 2, the height of the warning device, when folded is less than the height of the rails between which it is clamped ensuring clearance for all trains to pass thereover.

The flat panel form of the warning barrier sign enables it to be folded against the steps confined between the ladder frame uprights and within the profile thereof both to avoid risk of damage when used as a ladder and for compactness and ease of carrying.

As shown in FIG. 8, the hand held remote controller 23 is a box 33 of approximately 2 inches square with a push button 34 to activate the signal transmission and an indicator lamp 35 to confirm that the signal was in fact being transmitted.

Transit and train crews each have established procedures for alerting an oncoming train that personnel are working within the track area. The train would stop or slowdown until a beeper is activated by the crew foreman sending a signal to TRACY to lower the alert panel or warning barrier sign into the frame which is lower than the track top so that the train can pass thereover. Beeper signals are only activated by the designated crew members when he or she is ready to confirm that all members of the crew are safely distant from the track area and the train may proceed with caution until it has passed the work area.

TRACY is first be used as a ladder allowing crew members to enter a lower track area from a platform and then placed approximately 200 feet form the work area. The ladder or frame is then placed parallel to the rails onto the ties and then secured to the ties by the spring (alternatively screw) clamps. Once installed, the crew member carrying the beeper would test the device.

Figure 4:
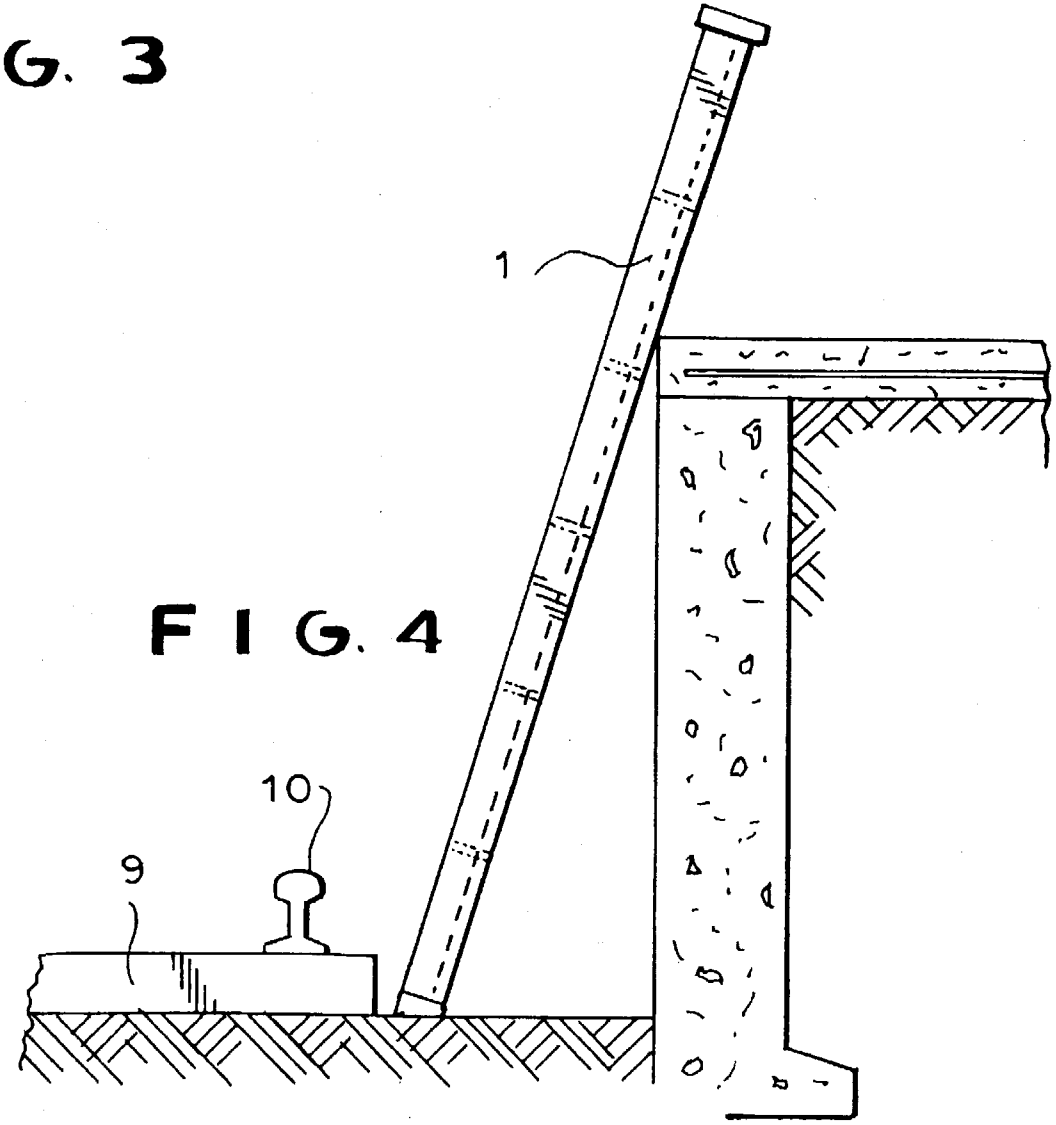
FIG. 4 is a side elevation of the first embodiment used as a ladder.

As shown in FIG. 4, the ladder frame is turned over and used as a ladder affording the crew ease of access to the track from an elevated platform.

Figure 6:
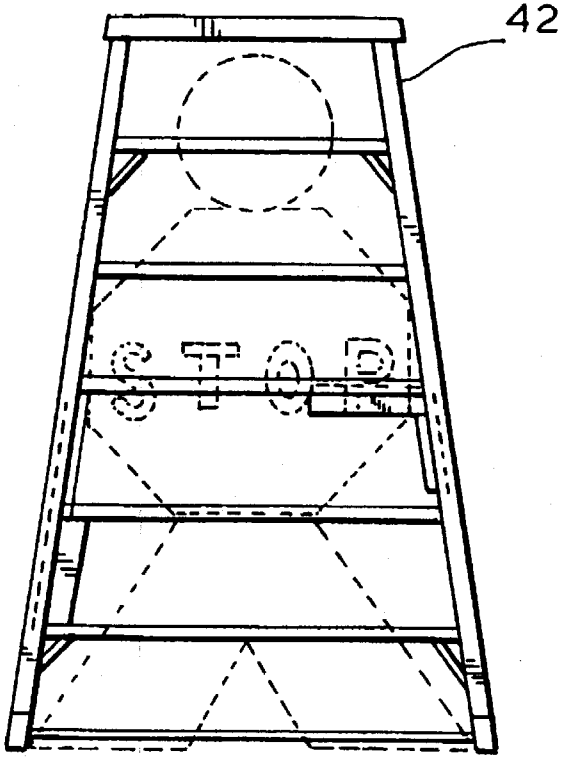
FIG. 6 is a schematic plan view of a second embodiment.

As shown in FIG. 6, according to a second embodiment, the ladder frame 42 is tapered to reduce size and weight and increase portability.

Figure 7:
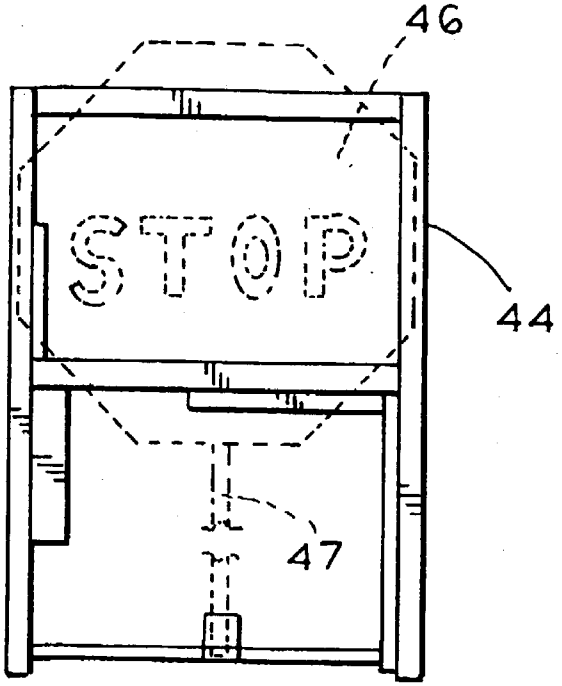
FIG. 7 is a schematic plan view of a third embodiment.

In the third embodiment shown in FIG. 7, the frame 44 is smaller being of approximately 3 feet by 2 and one quarter feet, with the warning barrier sign being a simple octagonal panel 46 carried by a post 47, for ease of portability and economy.

A safety switch can be provided on the warning device to sound an alarm if a train collides therewith.

It will be appreciated that the precise dimensions of the warning device may be altered to suit different requirements and regulations of the several regulatory bodies concerned with transit systems.

The beeper and signal receiver/micro computer for controlling operation utilize circuitry which will be known to the technician as will the suitable signal transmission frequencies.

I claim:

1. A portable, remote-control warning apparatus for rail transit systems comprising a remote-controlled, train warning device and a hand held remote controller therefor, the train warning device comprising:

an elongate ladder frame;

a warning barrier sign hingedly mounted on the ladder frame for movement between a retracted position, folded adjacent and along the ladder frame and an extended position, upstanding transversely from the ladder frame, respectively;

releasable clamping means on the ladder frame for securement thereof to rail ties to lie between a pair of tracks so that a train on the tracks can pass over the warning device with the warning barrier sign in retracted position;

an electric motor on the ladder frame connected to the warning barrier sign for effecting said movement;

a signal receiver/motor controller on the ladder frame connected to the electric motor for actuation thereof in response to a signal received from the hand held remote controller; and, battery means on the ladder frame connected for supplying power to the electric motor and the signal receiver, whereby operation of the hand held remote controller transmits a signal to the signal receiver to actuate the electric motor to move the warning barrier into said extended, position upstanding from the tracks in the path of a train and into said retracted position lying substantially horizontally between the tracks, to stop and release a train, respectively.

2. Apparatus according to claim 1 wherein the barrier warning sign comprises a reflective panel having a form of a human character.

3. Apparatus according to claim 2 wherein the barrier warning sign has a strobe light mounted thereon for operation by the signal receiver.

4. Apparatus according to claim 2 wherein the reflective panel has an arm carrying a strobe light at a free end thereof and is hingedly connected at a root end thereof to a body portion and spring biased for movement from a concealed position, folded between the panel and the ladder frame, to an open position in which it extends outward away from the body in a plane of the panel when the warning barrier sign moves from the retracted to the extended position.

5. Apparatus according to claim 2 wherein, the warning sign is wholly contained between the ladder frame uprights and within the profile thereof when in the retracted position.

6. Apparatus according to claim 1 wherein the releasable clamping means comprise spring clamps mounted on respective opposite longitudinal ends of the ladder frame.

7. Apparatus according to claim 1 wherein the barrier warning sign comprises a reflective panel which is hingedly mounted on the ladder by a shaft which is mounted for rotation between opposite uprights of the ladder frame and fixed to a lower end of the panel.

8. Apparatus according to claim 1 wherein the electric motor is connected to the warning barrier sign by a scissor type linkage having links arrange to be moved apart by operation of the motor to extend the panel to the erect position.

9. A portable, remote-control warning apparatus for rail transit systems comprising a remote-controlled, train warning device and a hand held remote controller therefor, the train warning device comprising:

a frame;

a warning barrier sign hingedly mounted on the frame for movement between a retracted position, folded adjacent the frame and an extended position, upstanding transversely from the frame, respectively;

releasable clamping means on the frame for securement thereof to rail ties to lie between a pair of tracks so that a train on the tracks can pass over the warning device with the warning barrier sign in retracted position;

an electric motor on the frame connected to the warning barrier sign for effecting said movement;

a signal receiver/motor controller on the frame connected to the electric motor for actuation thereof in response to a signal received from the hand held remote controller; and, battery means on the frame connected for supplying power to the electric motor and the signal receiver.

10. Apparatus according to claim 9 wherein the barrier warning sign comprises a reflective panel.

11. Apparatus according to claim 9 wherein the barrier warning sign comprises a reflective panel which is hingedly mounted on the ladder by a shaft which is mounted for rotation between a pair of parallel member of the frame and fixed to a lower end of the panel.

* * * * *